US012186636B2

(12) United States Patent
Hallet

(10) Patent No.: US 12,186,636 B2
(45) Date of Patent: Jan. 7, 2025

(54) PUTTER WITH ADJUSTABLE TOP PLATE

(71) Applicant: Callaway Golf Company, Carlsbad, CA (US)

(72) Inventor: Nicholas F. Hallet, Encinitas, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 279 days.

(21) Appl. No.: 17/823,936

(22) Filed: Aug. 31, 2022

(65) Prior Publication Data

US 2024/0066369 A1 Feb. 29, 2024

(51) Int. Cl.
*A63B 53/06* (2015.01)
*A63B 53/00* (2015.01)

(52) U.S. Cl.
CPC ..... *A63B 53/065* (2013.01); *A63B 53/007* (2013.01)

(58) Field of Classification Search
CPC . A63B 53/065; A63B 53/007; A63B 69/3676; A63B 69/3632; A63B 69/3685
USPC ..... 473/219, 226, 238, 242, 249, 251
See application file for complete search history.

(56) References Cited

U.S. PATENT DOCUMENTS 4,659,083 A 4/1987 Szczepanski
4,688,798 A 8/1987 Pelz
D559,930 S * 1/2008 Cameron ..... D21/746
7,371,184 B2 5/2008 Tao
7,384,345 B2 * 6/2008 Sherman ..... A63B 53/0487 473/340
D620,993 S * 8/2010 Laub ..... D21/746
9,314,678 B2 * 4/2016 Quan ..... A63B 53/007
9,415,279 B2 8/2016 Foster
9,844,716 B2 * 12/2017 Foster ..... A63B 53/04
10,004,959 B1 * 6/2018 Myers ..... A63B 53/0487
11,918,869 B2 * 3/2024 Parsons ..... A63B 53/0487
11,980,794 B1 * 5/2024 Englefield ..... A63B 53/0441
2005/0187028 A1 * 8/2005 Chang ..... A63B 53/0487 473/238
2005/0192114 A1 * 9/2005 Zider ..... A63B 53/0487 473/251
2006/0068935 A1 * 3/2006 Tang ..... A63B 60/02 473/340
2007/0191130 A1 * 8/2007 Kouldus ..... A63B 60/02 473/251
2009/0082123 A1 * 3/2009 Armstrong ..... A63B 53/0487 473/251
2009/0149274 A1 * 6/2009 Rollinson ..... A63B 53/04 473/340
2009/0170622 A1 * 7/2009 Hilton ..... A63B 53/0487 473/340
2009/0170629 A1 * 7/2009 Hilton ..... A63B 53/0487 473/340

(Continued)

OTHER PUBLICATIONS

WO-2008154684-A1, titled "A Golf Club Head", with Inventor named Sherman Robyn Ann; pp. 1-29, Published Dec. 24, 2008. (Year: 2008).*

(Continued)

*Primary Examiner* — Sebastiano Passaniti
(74) *Attorney, Agent, or Firm* — Michael A. Catania

(57) ABSTRACT

An adjustable golf club putter head is disclosed herein. The putter head includes a removable top plate that can be swapped with a different top plate with a different material composition and alignment pattern to affect the cosmetics of the putter head and also adjust the putter head's mass properties.

14 Claims, 3 Drawing Sheets

(56) References Cited

U.S. PATENT DOCUMENTS

| | | | | |
|---|---|---|---|---|
| 2010/0048330 | A1* | 2/2010 | Simmons | A63B 53/065 473/409 |
| 2016/0220875 | A1* | 8/2016 | Sanyal | A63B 53/065 |

OTHER PUBLICATIONS

"Detour Newport 2—Archival Putter 2007" <https://www.scottycameron.com/archives/putters/2007/detour/newport-2-detour/> Last Accessed on Aug. 30, 2022.

* cited by examiner

PUTTER WITH ADJUSTABLE TOP PLATE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a putter type golf club head comprising a removeable top plate, which may include alignment or decorative markings. The present invention more specifically relates to a putter-type golf club head having replaceable alignment markings on its top surface to help a golfer line up the golf club head with a golf ball.

Description of the Related Art

The golf industry routinely develops putters that are intended make the game of golf easier for the high handicap player. One such putter is disclosed in U.S. Pat. No. 4,688,798 to David Pelz, which discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter. The large number of converging lines taught by Szczepanski can be distracting to a golfer, however.

A further patent that discloses an alignment means is U.S. Pat. No. 7,371,184 to Tao. The Tao patent also discloses a group of lines that converge at the center of the face of a putter.

Although these inventions have provided putters for making the game of golf more enjoyable for high handicap players, the prior art has not optimized an adjustable putter alignment feature for high handicap players.

BRIEF SUMMARY OF THE INVENTION

One aspect of the present invention is a putter head comprising a removable top plate, which may include alignment markings.

Another aspect of the present invention is a putter comprising a body comprising a face portion, a top shelf, and a sole portion, and a top plate comprising at least one alignment feature disposed on an upper surface and a snap feature extending from a lower surface, wherein the snap feature is sized to removably grip at least a portion of the top shelf. In some embodiments, the putter may further comprise a mechanical fastener, the snap feature may comprise a through-opening, the top shelf may comprise a threaded bore aligned substantially perpendicular to the face portion, the threaded bore may align with the through opening when the snap feature is engaged with the top shelf, and at least a portion of the mechanical fastener may be sized to extend through the through-opening and engage with the threaded bore to removably secure the top plate to the top shelf. The top plate is a cantilever plate extending rearwardly from adjacent the striking face and is only supported by the face portion of the body, wherein a majority of a length of the cantilever plate is unsupported, and wherein the cantilever plate forms a crown of the putter body.

In other embodiments, the alignment feature may comprise at least two circles, and/or may comprise at least one line extending perpendicular to the face portion. In some embodiments, the sole portion may extend rearwards from a lower edge of the face portion, and the top shelf may extend rearwards from an upper edge of the face portion. In any embodiment, the body may be composed of a metal material selected from the group of steel, tungsten alloy, and titanium alloy. In other embodiments, the top plate may be composed of a non-metal material, which may be selected from the group consisting of plastic and composite.

Another aspect of the present invention is a kit comprising a putter body comprising a face portion, a top shelf, and a sole portion, a first top plate comprising a first alignment feature disposed on a first upper surface and a first snap feature extending from a second lower surface, and a second top plate comprising a second alignment feature disposed on a second upper surface and a second snap feature extending from a second lower surface, wherein each of the first snap feature and the second snap feature is sized to removably grip at least a portion of the top shelf, wherein the sole portion extends rearwards from a lower edge of the face portion, wherein the top shelf extends rearwards from an upper edge of the face portion, and wherein the first alignment feature is different from the second alignment feature.

In some embodiments, at least one of the first alignment feature and the second alignment feature may comprise a circle having a diameter approximately equivalent to that of a golf ball. In other embodiments, at least one of the first alignment feature and the second alignment feature may comprise at least one line extending perpendicular to the face portion. In any embodiment, the first top plate may be composed of a first material, and the second top plate may be composed of a second material that differs from the first material. Also in any embodiment, the body may be composed of a metal material selected from the group of steel, tungsten alloy, and titanium alloy. In a further embodiment, each of the first top plate and the second top plate may be composed of a non-metal material, which may be selected from the group consisting of plastic and composite. In another embodiment, the kit may further comprise a mechanical fastener, each of the first snap feature and the second snap feature may comprise a through-opening, the top shelf may comprise a threaded bore extending substantially perpendicular to the face portion, the threaded bore may align with a through-opening when the one of the first snap feature and the second snap feature is engaged with the top shelf, and at least a portion of the mechanical fastener may be sized to extend through the through-opening and engage with the threaded bore to removably secure one of the first top plate and the second top plate to the top shelf.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
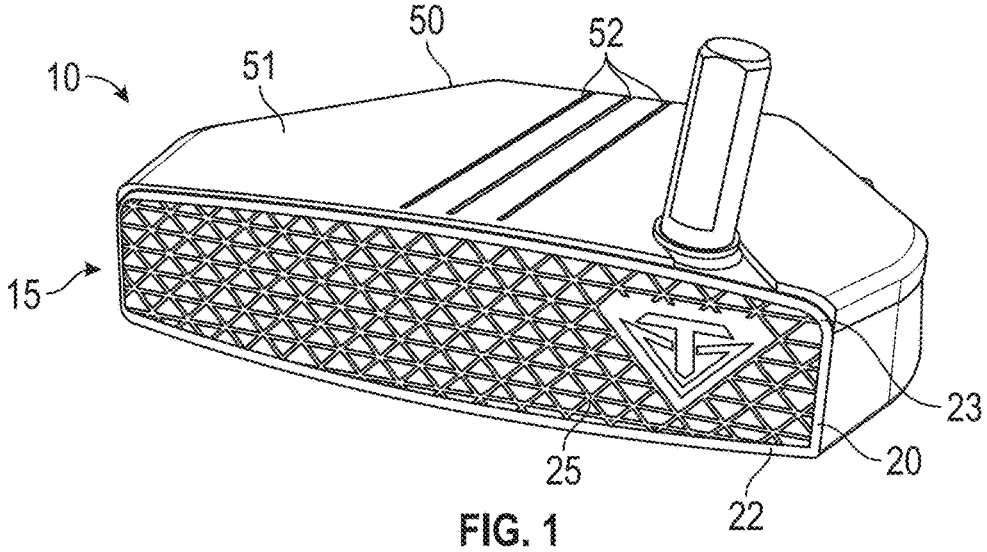
FIG. 1 is a front perspective view of a preferred embodiment of the present invention.
Figure 2:
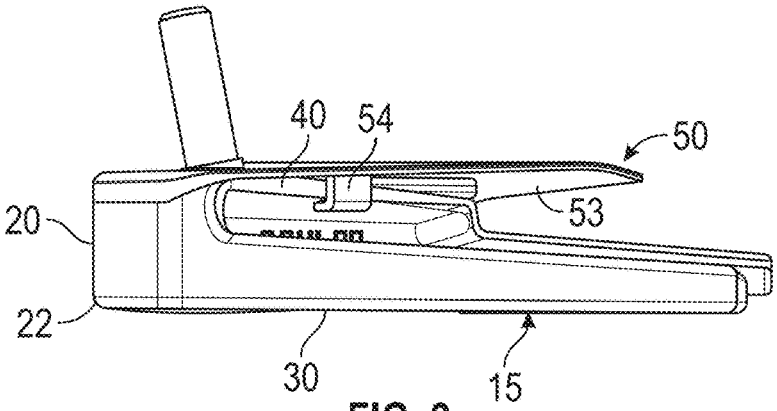
FIG. 2 is a side perspective view of the embodiment shown in FIG. 1.
Figure 3:
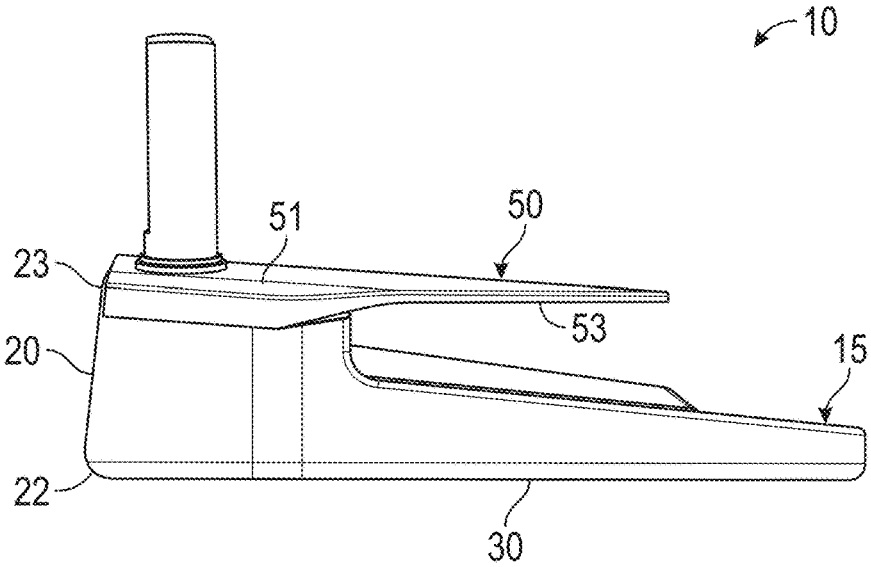
FIG. 3 is a side plan view of the embodiment shown in FIG. 1.
Figure 4:
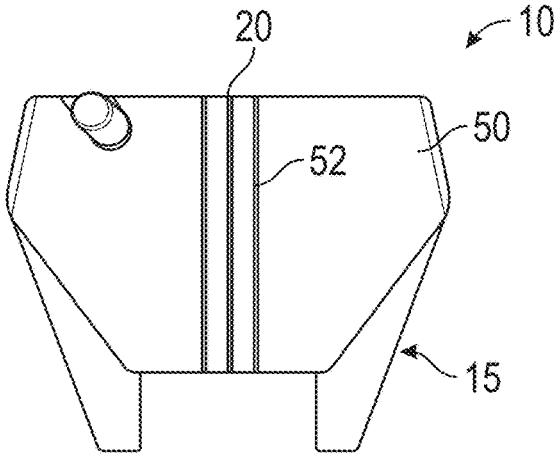
FIG. 4 is a top plan view of the embodiment shown in FIG. 1.
Figure 5:
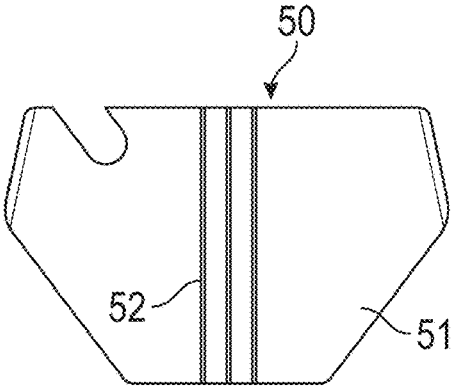
FIG. 5 is a top plan view of the top plate shown in FIG. 1.
Figure 6:
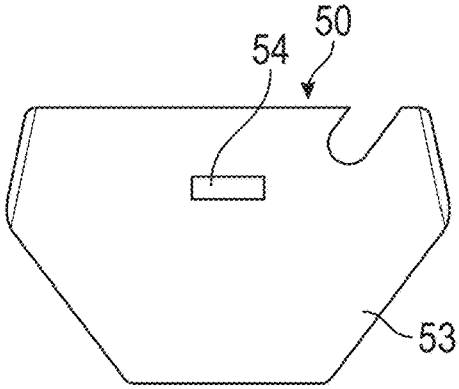
FIG. 6 is a bottom plan view of the embodiment shown in FIG. 5.
Figure 7:
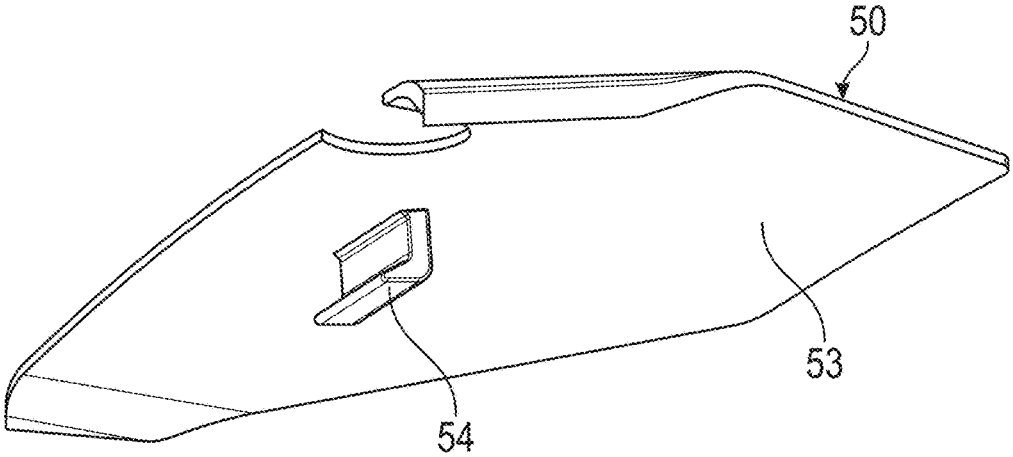
FIG. 7 is a bottom perspective view of the embodiment shown in FIG. 5.

A preferred embodiment of the present invention is shown in FIGS. 1-7. In this embodiment, a putter-type club head 10 comprises a body 15 having a face portion 20 with a striking face 25 and a sole 30 extending rearwards from a lower edge 22 of the face portion 20, such that the body 15 has an L-shaped structure. The body 15 also includes a top shelf 40 extending rearwards from an upper edge 23 of the face portion 20. The body 15 preferably is composed of a metal material such as steel, tungsten, or titanium, and its L-shaped structure positions the center of gravity at a low, forward position on the head 10.

The head 10 also includes a removable top plate 50 comprising one or more alignment features 52 disposed on an upper surface 51 and a snap feature 54 extending from a central region 55 of the lower surface 53 of the top plate 50. The snap feature 54 is sized to firmly grip the top shelf 40 via friction, but preferably is loose enough to allow the top plate 50 to be removed by hand. The alignment feature 52 of the preferred embodiment comprises several lines extending perpendicular to the striking face 25. The top plate 50 preferably is composed of a non-metal material, such as a polymer or composite, but can be formed of a metal material if a user wishes to raise the center of gravity location or otherwise adjust the mass properties of the putter head 10.

Figure 8:
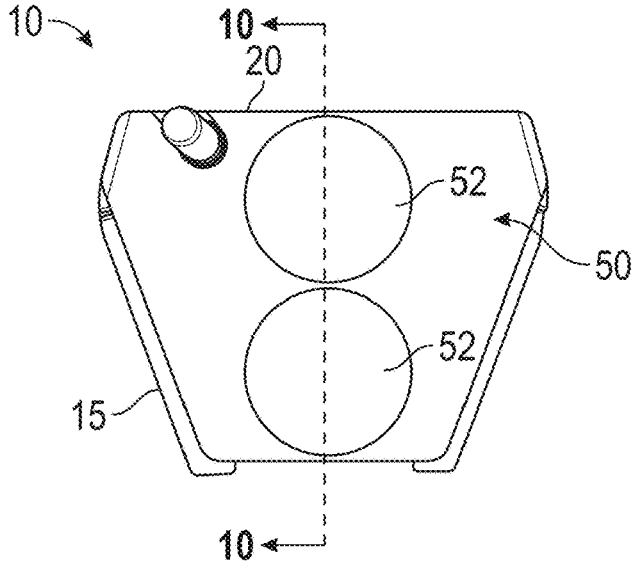
FIG. 8 is a top plan view of an alternative embodiment of the present invention.
Figure 9:
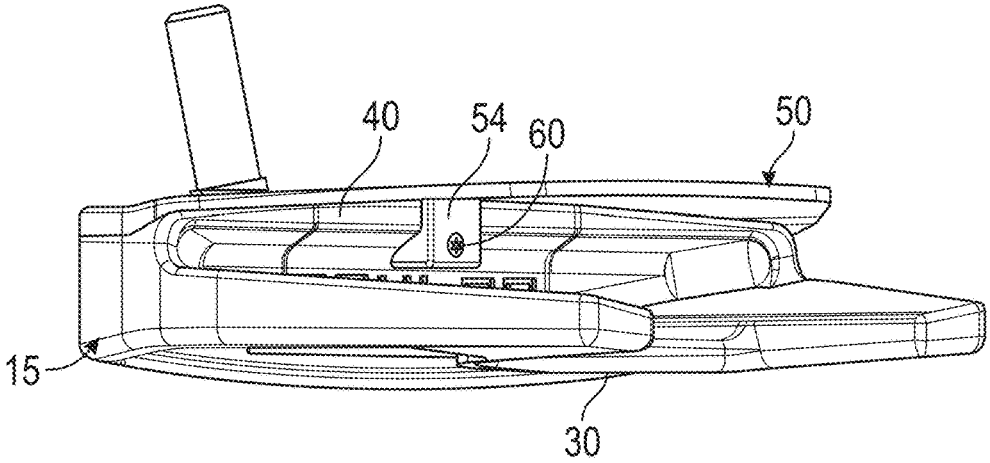
FIG. 9 is a rear perspective view of the embodiment shown in FIG. 8.
Figure 10:
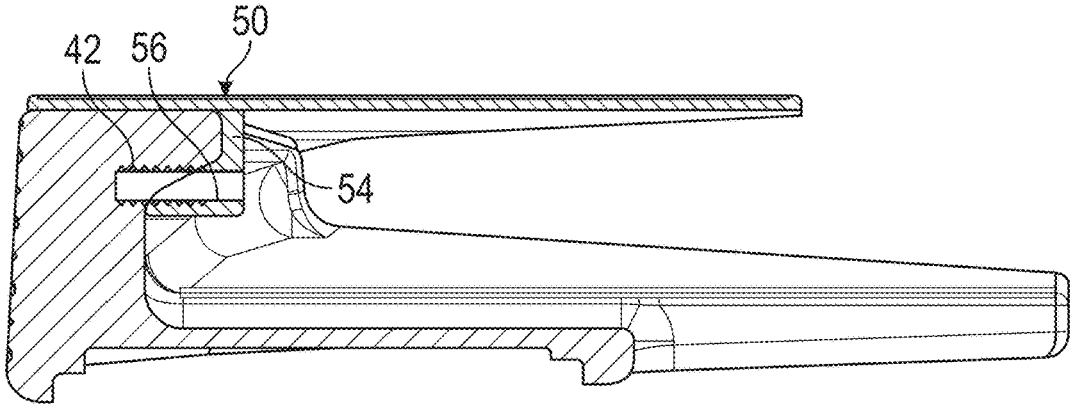
FIG. 10 is a cross-sectional view of the embodiment shown in FIG. 8 taken along lines 10-10.

In an alternative embodiment, shown in FIGS. 8-10, the alignment feature 52 may comprise a pair of circles having the approximate diameter of a golf ball. Also in this embodiment, the top plate 50 is further secured to the top shelf 40 via a mechanical fastener 60 such as a bolt or screw that extends through the snap feature 54 via a through-opening 56 and engages with a threaded opening 42 extending substantially perpendicular to the face portion and extending into the top shelf 40. The top plate 50 is a cantilever plate extending rearwardly from adjacent the striking face 25 and is only supported by the face portion 20 of the putter body 15, wherein a majority of a length of the cantilever plate is unsupported, and wherein the cantilever plate forms a crown of the putter body 15.

In another embodiment, the putter head 10 may be sold as a kit to consumers, with a single body 15 and multiple top plates 50 having different shapes, colors, alignment features 52, and/or material compositions to allow a consumer to customize the putter head 10 for optimal performance.

The embodiments disclosed herein may include any of the features of the golf club heads disclosed in U.S. Pat. Nos. 7,244,191 and 8,480,504, the disclosure of each of which is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A putter comprising:

a putter body comprising a face portion with a striking face, a top shelf, and a sole portion;

a mechanical fastener; and a top plate comprising at least one alignment feature disposed on an upper surface and a snap feature extending from a lower surface, wherein the snap feature is sized to removably grip at least a portion of the top shelf;

wherein the snap feature comprises a through-opening, wherein the top shelf comprises a threaded bore aligned substantially perpendicular to the face portion, wherein the threaded bore aligns with the through opening when the snap feature is engaged with the top shelf, and wherein at least a portion of the mechanical fastener is sized to extend through the through-opening and engage with the threaded bore to removably secure the top plate to the top shelf;

wherein the top plate is a cantilever plate extending rearwardly from adjacent the striking face and is only supported by the face portion of the putter body, wherein a majority of a length of the cantilever plate is unsupported, and wherein the cantilever plate forms a crown of the putter body.

2. The putter of claim 1, wherein the alignment feature comprises at least two circles.

3. The putter of claim 1, wherein the alignment feature comprises at least one line extending perpendicular to the face portion.

4. The putter of claim 1, wherein the sole portion extends rearwards from a lower edge of the face portion, and wherein the top shelf extends rearwards from an upper edge of the face portion.

5. The putter of claim 1, wherein the body is composed of a metal material selected from the group of steel, tungsten alloy, and titanium alloy.

6. The putter of claim 1, wherein the top plate is composed of a non-metal material.

7. The putter of claim 6, wherein the non-metal material is selected from the group consisting of plastic and composite.

8. A kit comprising:

a putter body comprising a face portion with a striking face, a top shelf, and a sole portion;

a first top plate comprising a first alignment feature disposed on a first upper surface and a first snap feature extending from a second lower surface; and a second top plate comprising a second alignment feature disposed on a second upper surface and a second snap feature extending from a second lower surface, wherein each of the first snap feature and the second snap feature is sized to removably grip at least a portion of the top shelf, wherein the sole portion extends rearwards from a lower edge of the face portion, wherein the top shelf extends rearwards from an upper edge of the face portion, and wherein the first alignment feature is different from the second alignment feature;

wherein each of the first snap feature and the second snap feature comprises a through-opening, wherein the top shelf comprises a threaded bore aligned substantially perpendicular to the face portion, wherein the threaded bore aligns with a through-opening when the one of the first snap feature and the second snap feature is engaged with the top shelf, and wherein at least a portion of the mechanical fastener is sized to extend through the through-opening and engage with the threaded bore to removably secure one of the first top plate and the second top plate to the top shelf;

wherein the first top plate and the second top plate are each a cantilever plate extending rearwardly from adjacent the striking face and are each only supported by the face portion of the putter body, wherein a majority of a length of the cantilever plate is unsupported, and wherein the cantilever plate forms a crown of the putter body.

9. The kit of claim 8, wherein at least one of the first alignment feature and the second alignment feature comprises a circle having a diameter approximately equivalent to that of a golf ball.

10. The kit of claim 8, wherein at least one of the first alignment feature and the second alignment feature comprises at least one line extending perpendicular to the face portion.

11. The kit of claim 8, wherein the first top plate is composed of a first material, and wherein the second top plate is composed of a second material that differs from the first material.

12. The kit of claim 8, wherein the body is composed of a metal material selected from the group of steel, tungsten alloy, and titanium alloy.

13. The kit of claim 12, wherein each of the first top plate and the second top plate is composed of a non-metal material.

14. The kit of claim 13, wherein the non-metal material is selected from the group consisting of plastic and composite.

* * * * *